US009301059B2

(12) United States Patent
Hamacher

(10) Patent No.: US 9,301,059 B2
(45) Date of Patent: Mar. 29, 2016

(54) BONE CONDUCTION HEARING AID SYSTEM

(75) Inventor: Volkmar Hamacher, Hannover (DE)

(73) Assignee: Advanced Bionics AG, Stäfa (CH)

( * ) Notice: Subject to any disclaimer, the term of this patent is extended or adjusted under 35 U.S.C. 154(b) by 524 days.

(21) Appl. No.: 13/701,956

(22) PCT Filed: Jun. 7, 2010

(86) PCT No.: PCT/EP2010/057929
§ 371 (c)(1),
(2), (4) Date: Mar. 4, 2013

(87) PCT Pub. No.: WO2010/094812
PCT Pub. Date: Aug. 26, 2010

(65) Prior Publication Data

US 2013/0156202 A1 Jun. 20, 2013

(51) Int. Cl.
*H04R 25/00* (2006.01)

(52) U.S. Cl.
CPC ..... *H04R 25/43* (2013.01); *H04R 25/453* (2013.01); *H04R 25/552* (2013.01); *H04R 25/606* (2013.01); *H04R 25/554* (2013.01); *H04R 2460/13* (2013.01)

(58) Field of Classification Search
CPC ..... H04R 25/606; H04R 2225/43; H04R 2460/13
USPC ..... 381/317, 326, 71.2, 71.7
See application file for complete search history.

(56) References Cited

U.S. PATENT DOCUMENTS 3,894,196 A * 7/1975 Briskey ..... 381/23.1
5,694,474 A * 12/1997 Ngo et al. ..... 381/66
(Continued)

FOREIGN PATENT DOCUMENTS

EP 2 148 527 A1 1/2010
WO 2009/101622 A2 8/2009

OTHER PUBLICATIONS

Database Medline [Online], US National Library of Medicine (NLM), Bethesda, MD, US; Mar. 1998, Snik AF, Beynon AJ, Mylanus EA, Van Der Pouw CT, Cremers CW: Binaural Applicaiton of the Bone-Anchored Heairng Aid; EXP-002616907; Database Accession No. NLM9525238, Abstract, & Annals of Otology, Rhinology and Laryngology, vol. 107, No. 3 Mar. 31, 1998.
(Continued)

*Primary Examiner* — Alexander Jamal
(74) *Attorney, Agent, or Firm* — Roberts Mlotkowski Safran & Cole, PC; David S. Safran

(57) ABSTRACT

A bone conduction hearing aid system with right and left ear microphone arrangements; right and left ear ambient sound signal processing units, right and left ear bone conduction output transducers for stimulating the user's right and left ear cochlea, respectively; a right and left ear cross-talk compensation filter units for generating right and left ear crosstalk compensation signals, respectively, from the processed audio signals of the respective signal processing unit according to an estimated transcranial transfer function; and means for subtracting the left ear cross-talk compensation signal from the processed audio signals of the right ear signal processing unit to generate the right ear output audio signals, and means for subtracting the right ear cross-talk compensation signal from the processed audio signals of the left ear signal processing unit to generate the left ear output audio signals.

19 Claims, 3 Drawing Sheets

(56) References Cited

U.S. PATENT DOCUMENTS

| | | | | |
|---|---|---|---|---|
| 2006/0087203 | A1* | 4/2006 | Cho | 310/353 |
| 2009/0245553 | A1 | 10/2009 | Parker | |
| 2009/0247810 | A1 | 10/2009 | Parker et al. | |
| 2011/0264155 | A1* | 10/2011 | Van den Heuvel et al. | 607/3 |

OTHER PUBLICATIONS

Junseong Kim, Sanggyun Kim, and Change D. Yoo, A Novel Adaptive Crosstalk Cancellation Using Psychoacoustic Model for 3D Audio, IEEE International Conference on Acoustics, Speech, and Signal Processing, Apr. 15, 2007, pp. I-185-I-188.

Abdulrahman Hagr, BAHA: Bone-Anchored Hearing Aid, International Journal of Health Sciences, Qassim University, vol. 1, No. 2, (Jul. 2007/JUMADA 11 1428N), pp. 265-276.

P. Damaske, Head-Related Two-Channel Stereophony With Loudspeaker Reproduction, The Journal of the Acoustical Society of America, Received Nov. 24, 1970, vol. 50, No. 4, (Part 2), pp. 1109-1115.

Stefan Stenfelt and Richard L. Goode, Transmission Properties of Bone Conducted Sound: Measuremeents in Cadaver Heads, J. Acoust. Soc. Am. 118(4), Oct. 2005, pp. 2373-2391.

Volkmar Hamacher, Ulrich Kornagel, Thomas Lotter, Henning Puder, Binaural Signal Processing in Hearing Aids: Technologies and Algorithms, Template for Book Projekt, pp. 1-35.

* cited by examiner

BONE CONDUCTION HEARING AID SYSTEM

BACKGROUND OF THE INVENTION

1. Field of the Invention

The invention relates to a bilateral hearing aid system comprising at least one bone conduction output transducer.

2. Description of Related Art

Examples of bone conduction hearing aid systems are described in U.S. Patent Application Publications 2009/0245553 A1 and 2009/0247810 A1.

Bone conduction hearing aids are used by patients who cannot benefit from electro-acoustic hearing aids. Most of them are suffering from malformed ears, conductive hearing loss or single-sided deafness.

In general, bone conduction hearing aids use a mechanical transducer coupled to the skull to directly transfer sound vibrations through the bone to the cochlea, thereby bypassing the outer and the middle ear.

In case of non-implanted devices the transducer may be incorporated in a BTE (Behind The Ear) housing or an ITE (In the Ear) shell, having direct contact to the skull with the skin in-between, or it may be coupled to the skull using a head belt or an eyeglass adapter, or it may be coupled to the teeth.

In bone-anchored devices, surgically implanted abutments in the skull are used to achieve an improved coupling between the transducer and the skull. Such abutments may be magnets offering a strong transcutaneous magnetic coupling with the externally located transducer, or they may be designed as a percutaneous "screw" on which the transducer is sitting.

Usually the transducer forms part or is connected to an external sound processor, which typically is a BTE- or ITE-type device comprising one or more microphones, a signal processing and amplification unit and a driver for the transducer. The sound processor device is usually placed close to the ear to provide the most natural sound pick up position for the microphones. The transducer may be integrated in the sound processor housing or it may be a separate element connected by wire or by a wireless radio link to the sound processor.

It is generally desirable to fit hearing aids bilaterally in order to achieve the well-known advantages of binaural hearing in terms of speech understanding, sound quality and spatial hearing.

However, the benefit of bilateral fittings is limited in case of bone conduction hearing aids. The reason is that the interaural time differences (ITD) and interaural leveled differences (ILD) cues are disturbed due to the strong transcranial cross-talk effect of bone conduction. Bone-conducted vibrations reach the contralateral cochlea with an average attenuation of just about 10 dB compared to the ipsilateral cochlea. By contrast, for air conduction, i.e. electro-acoustic, hearing aids, the interaural attenuation typically is more than 50 dB. Hence, in case of bone conduction there is an unnatural interference of the sound coming from the ipsilateral transducer and the contralateral transducer. The result are deteriorated ITDs and ILDs, so that the benefit of binaural hearing is quite small compared to what could be expected is the cochleae received proper stimuli.

International Patent Application Publication WO 2009/101622 A2 relates to a sound system for reproducing recorded sound, comprising several loudspeakers and bone conduction speakers to be located at the right side and the left side of a user's head. It is mentioned that transcranial cross talking occurs with the use of bone conduction speakers, and a theoretical analysis of this effect is described. It is also mentioned that interesting effects can be achieved by controlling such cross-talking effect.

The article "Head-related two-channel stereophony with loudspeaker reproduction", by P. Damaske, JASA, Vol 50, 1971 relates to cross-talk compensation techniques for virtual acoustic imaging with two free-field loudspeakers.

SUMMARY OF THE INVENTION

It is an object of the invention to provide for a bilateral hearing aid system comprising at least one bone conduction output transducer, wherein binaural hearing effects should be preserved as far as possible. It is a further object of the invention to provide for a corresponding hearing assistance method.

According to the invention, these objects are achieved by a bilateral bone conduction hearing aid system, a corresponding hearing assistance method, a bimodal hearing aid system as defined in claim 9 and a corresponding hearing assistance method as described herewith.

The invention is beneficial in that, by exchanging cross-talk compensation signals generated according to the respective estimated transcranial transfer function between the right ear side and the left ear side and by subjecting such contralateral cross-talk compensation signal from the "direct" ipsilateral signal prior to supplying the ipsilateral signal as input to the bone conduction output transducer, cross talk compensation can be achieved, thereby preserving binaural effects.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
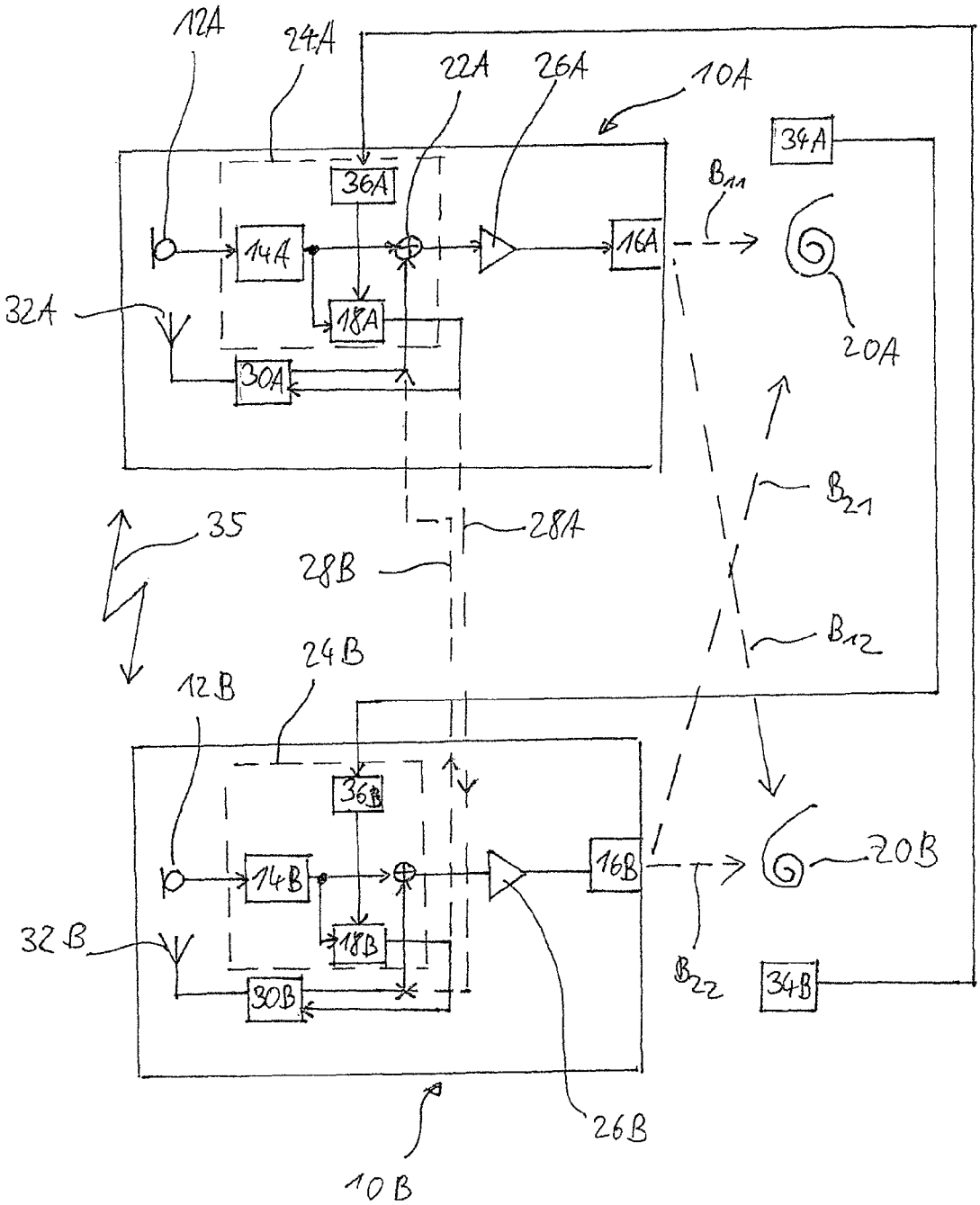
FIG. 1 is a block diagram of an example of a hearing aid system according to the invention comprising two bone conduction output transducers.

FIG. 1 shows a block diagram of an example of a bone conduction hearing aid system according to the invention, comprising a right ear hearing aid 10A and a left ear hearing aid 10B. The right ear hearing aid 10A comprises a microphone arrangement 12A for capturing audio signals from ambient sound, an audio signal processing unit 14A for processing the audio signals captured by the microphone arrangement 12A and a bone conduction output transducer 16A. The right ear hearing aid 10A also comprises a filter unit 18A for generating a right ear cross-talk compensation signal from the processed audio signals of the right ear audio signal processing unit 14A, according to an estimated transcranial transfer function from the right ear bone conduction output transducer 16A to the left ear cochlea 20B and an adder unit 22A for adding a left ear cross talk compensation signal received from the left ear hearing aid 10B to the processed audio signals produced by the right ear audio signal processing unit 14A. The units 14A, 18A and 22A typically will be implemented by a digital signal processor (DSP) 24A. The combined output signal of the adder 22A forms a right ear output audio signal, which is supplied, after having undergone amplification in a power amplifier 26A, as input to the output transducer 16A, which is located at or close to the user's right ear, and hence close to the user's right ear cochlea 20A, in order to stimulate the right ear cochlea 20A according to the right ear audio output signals.

The output transducer 16A may be a bone conduction transducer of any type. In particular, the output transducer 16A may be for direct contact with the skin at the user's skull, or it may be for engagement with implantable abutments. The output transducer 16A also may be coupled to the skull using a head belt or an eyeglass adapter, or it may be coupled to the teeth. The microphone arrangement 12A may comprise a single microphone or a plurality of spaced-apart microphones for enabling acoustic beam forming.

The right ear hearing aid 10A may be realized as a BTE hearing aid, ITE hearing aid or as part of an eyeglass frame. The output transducer 16A may be integrated in the housing of the hearing aid 10A, or it may be realized as an external part connected by wire or by using a wireless radio link to the hearing aid 10A.

The left ear hearing aid 10B comprises the like components as the right ear hearing aid 10A, but in a mirror-like manner, i.e. the left ear filter unit 18B is for generating a left ear cross-talk compensation signal from the processed audio signals of the left ear signal processing unit 14B according to an estimated transcranial transfer function from the left ear bone conduction output transducer 16B to the right ear cochlea 20A, and the adder unit 22B is for adding the right ear cross-talk compensation signal generated by the right ear filter unit 18B to the processed audio signals produced by the left ear audio signal processing unit 14B.

The hearing aids 10A, 10B also include means for exchanging the cross-talk compensation signals between the hearing aids, i.e. means for sending the right ear cross-talk compensation signal from the right ear filter unit 18A to the left hear hearing aid 10B and for sending the left ear cross-talk compensation signal from the left ear filter unit 18B to the right ear hearing aid 10A. Such signal exchange may be realized by a wire connection indicated at 28A and 28B in FIG. 1. Alternatively, the hearing aids 10A, 10B may comprise means for establishing a bidirectional wireless link 35 between the right ear hearing aid 10A and the left ear hearing aid 10B, which means include a right ear transceiver 30A of the right ear hearing aid 10A and a left ear transceiver 30B in the left ear hearing aid 10B, as well as respective antennas 32A in the right ear hearing aid 10A and 32B in the left ear hearing aid 10B.

Such wired or wireless bidirectional audio link between the right ear hearing aid 10A and the left ear hearing aid 10B may be used not only to exchange the cross-talk compensation signals, but also to exchange audio signals used for acoustic beam forming, noise reduction and/or auditory scene classification, see e.g. V. Hamacher, U. Kornagel, T. Lotter, H. Puder: "Binaural signal processing in hearing aids", in "Advanced in Digital Speech Transmission", R. Martin, U. Heute, C. Antweiler (eds.), p. 401-30, Wiley, 2008.

Figure 2:
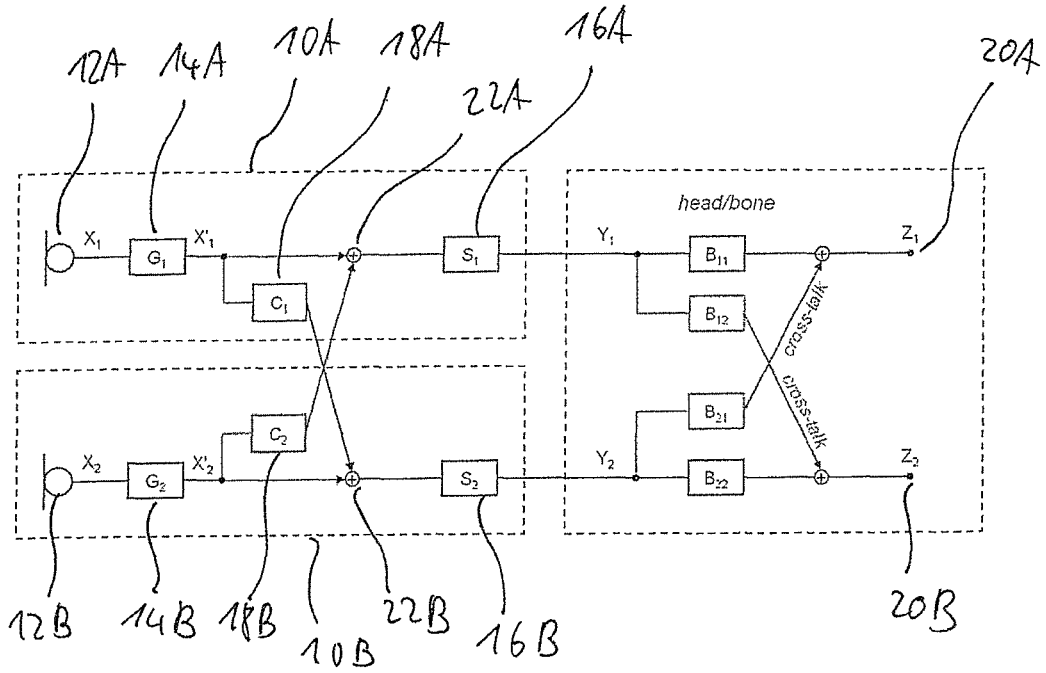
FIG. 2 is a signal processing model of an example of a fitting of a hearing aid system according to the invention.

In FIG. 2, a signal processing model of an example of a bilateral bone conduction hearing aid fitting according to the invention is shown, according to which sound is picked up at the right ear by the microphone 12A of the right ear hearing aid 10A and at and the left ear by the microphone 12B of the left ear hearing aid 10B, respectively. For simplification, a time discrete signal processing is assumed, so that the z-transform can be used to represent the signals in the "frequency domain". The audio signals captured by the microphones are then represented by $X_1(z)$ and $X_2(z)$, respectively. $G_1(z)$ and $G_2(z)$ represent a the transfer function of digital filter for amplification and frequency shaping (these filters correspond to the right ear audio signal processing unit 14A and the left ear audio signal processing unit 14B, respectively). The signals $X_1'(z)$ and $X_2'(z)$ result from applying these filters to $X_1(z)$ and $X_2(z)$, respectively. The transfer functions of the output transducers 16A and 16B are designated by $S_1(z)$ and $S_2(z)$, respectively, and the resulting bone vibration signals at the transducer contact points are designated by $Y_1(z)$ and $Y_2(z)$, respectively.

The cranial transfer functions from the transducer contact points to the ipsilateral cochlea 20A, 20B are represented by $B_{11}(z)$ and $B_{22}(z)$, respectively, while the transcranial transfer functions from the transducer coupling points to the contralateral cochlea 20B and 20A are designated by $B_{12}(z)$ and $B_{21}(z)$, respectively, with the transcranial transfer functions describing the transfer functions of the cross-talk paths. The sum of the sound arriving from the ipsilateral ("wanted") and the contralateral ("unwanted cross talk") transducer at the particular cochlea 20A or 20B is described by $Z_1(z)$ and $Z_2(z)$, respectively.

According to S. Stenfelt and R. L. Goode: "Transmission properties of bone conducted sound: Measurements in cadaver heads", JASA 118(4), p. 2373-91, the transmission of vibration in the skull below the first skull resonance frequency, which is approximately 1 kHz, can be approximated by a linear system; for higher frequencies it is not clear whether the bone conduction by the skull can be modeled by a digital filter. However, it is well-known that the frequencies below 1 kHz significantly contribute to binaural hearing benefits, so that a solution reducing cross talk below 1 kHz would be beneficial.

It is the object of the invention to eliminate, as far as possible, the cross-talk signals caused by the transcranial transfer functions $B_{12}$ and $B_{21}$. To this end, the right ear hearing aid 10A is provided with a filter unit 18A providing for a transfer function $C_1(z)$, and the left ear hearing aid 10B is provide with a filter unit 18B providing for a transfer function $C_2(z)$. The filter unit 18A provides for a right ear cross-talk compensation signal, and the filter unit 18B provides for a left ear cross-talk compensation signal, respectively, which signal is combined with the respective contralateral processed audio signal $X_1'(z)$ and $X_2'(z)$. In practice, the cross-talk compensation signals are negative, so that the respective cross talk compensation signal actually is subtracted from the respective contralateral processed audio signal in order to generate the output signal supplied to the transducer 16A and 16B, respectively.

The signals $Z_1(z)$ and $Z_2(z)$ arriving at the right ear cochlea 20A and the left ear cochlea 20B, respectively, is given by (in the following "z" will be omitted for simplification):

$$\begin{aligned} Z_1 &= B_{11}S_1[G_1X_1 + C_2G_2X_2] + B_{21}S_2[G_2X_2 + C_1G_1X_1] \\ &= X_1G_1[B_{11}S_1 + B_{21}S_2C_1] + X_2G_2[B_{21}S_2 + B_{11}S_1C_2] \end{aligned} \quad (1)$$

$$\begin{aligned} Z_2 &= B_{22}S_2[G_2X_2 + C_1G_1X_1] + B_{12}S_1[G_1X_1 + C_2G_2X_2] \\ &= X_2G_2[B_{22}S_2 + B_{12}S_1C_2] + X_1G_1[B_{12}S_1 + B_{22}S_2C_1] \end{aligned} \quad (2)$$

If the Filters $C_1(z)$ and $C_2(z)$ are chosen to:

$$C_1 = -[B_{12}S_1]/[B_{22}S_2] \quad (3)$$

$$C_2 = -[B_{21}S_2]/[B_{11}S_1] \quad (4)$$

the cross-talk is cancelled out, i.e. both cochlear receive only bone conducted signals coming from the ipsilateral transducer.

For $Z_1(z)$ and $Z_2(z)$ one then finds:

$$Z_1=G_1S_1B_{11}[1-(B_{21}B_{12})/(B_{11}B_{22})]X_1 \quad (5)$$

$$Z_2=G_2S_2B_{22}[1-(B_{21}B_{12})/(B_{11}B_{22})]X_2 \quad (6)$$

In other words, for generating the cross-talk compensation signals not only the estimated transcranial transfer function but also the estimated ipsilateral cranial transfer function is taken into account. In particular, the right ear cross-talk compensation signal may be generated by amplifying the processed right ear audio signals, i.e. the output signals of the right ear audio signal processing unit 14A, by a factor corresponding to the ratio of the cranial transfer functions from the right ear output transducer 16A to the right ear cochlea 20A and the transcranial transfer functions from the left ear output transducer 16B to the right ear cochlea 20A, multiplied by the ratio of the right ear output transducer transfer function to the left ear output transducer transfer function. The left ear cross-talk compensation signal is generated analogously.

These transfer functions $B_{11}$, $B_{12}$, $B_{22}$ and $B_{21}$ may be estimated by picking up bone conduction sound reaching the right ear cochlea 20A and bone conduction sound reaching the left ear cochlea 20B by using vibration sensors, such as accelerometer sensors, 34A and 34B attached to the skull on the mastoid at a position as close to the respective cochlea 20A, 20B as possible, and wherein the bone conduction sound is generated by the right ear output transducer 16A and the left ear output transducer 16B, respectively. Since the transfer functions $B_{11}$, $B_{12}$, $B_{22}$ and $B_{21}$ usually do not change, the accelerometer sensors, 34A and 34B are removed after the fitting procedure.

The best measurement position, of course, would be the respective cochlea 20A, 20B itself. However, in view of the relatively large wavelength of bone conducted sound, the cross-talk cancellation effect provided by the present invention at a place quite close to the cochlea should not deviate too much from the effect at the cochlea itself.

Figure 3:
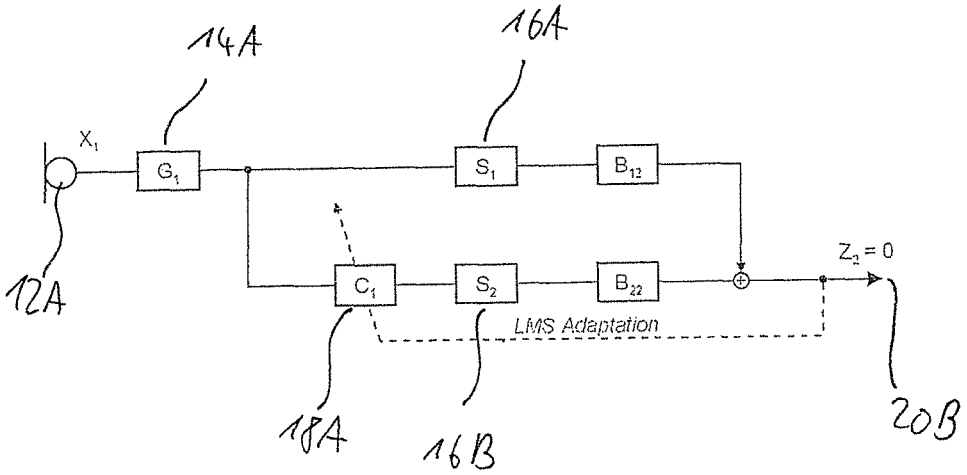
FIG. 3 is a block diagram of an example of an estimation of the transfer functions used in a hearing aid system according to the invention.

For the calculation of the transfer functions, which has to deal with stability, causality and delay issues, signal processing techniques known from virtual audio imaging can be applied, such as techniques described in J. Kim, S. Kim, C. Yoo, "A Novel Adaptive Crosstalk Cancellation using Psychoacoustic Model for 3D Audio", Proceedings Acoustics, Speech and Signal Processing, 2007, ICASSP 2007, Vol. 1, p. I-185-1-188. The transcranial transfer function $B_{12}$, $B_{21}$ and the cranial transfer function $B_{11}$, $B_{22}$ for each of the ears may be estimated by using the both output transducers 16A, 16B, the ipsilateral vibration sensor (which is in case of the left ear the sensor 34B), and the contralateral processed audio signals (in this case the audio signals generated by the right ear audio signal processing unit 14A from the audio signals captured by the right ear microphone arrangement 12A), while the ipsilateral audio signal processing unit (here the left ear unit 14B) is not involved. Then the cross-talk compensation signal provided by the contralateral filter unit (here the right ear unit 18A) is adjusted so as to minimize the signal picked up by the ipsilateral vibration sensor 34B. For minimizing the signal picked up by the ipsilateral vibration sensor 34B a least mean squares (LMS) algorithm may be used. An example of such measurement configuration is shown in FIG. 3 for the left ear; the set-up of FIG. 3 involves the transfer functions $B_{12}$ and $B_{22}$ for determining the transfer function $C_1$ of the right ear filter unit 18A. The desired transfer function $C_2$ of the filter unit 18B of the left ear hearing aid may be determined by an analogous set-up using the right ear vibration sensor 34A.

Alternatively, standard filters based on empiric cranial transfer function data averaged across a large group of persons, i.e., "default filters" based on measured transfer functions averaged across a large group of persons, may be used for determining the transfer functions of the filter units 18A, 18B.

In addition, after minimizing the signal picked up by the ipsilateral vibration sensor as described with regard to FIG. 3, the transfer functions $C_1$, $C_2$ of the filter units 18A and 18B, i.e., the cross-talk compensation signals, may be further adjusted by loudness measurements, so as to minimize loudness perception in the ipsilateral ear.

Alternatively, the cross-talk compensation signal may be adjusted so as to minimize the measured vibrations of the middle ear ossicles, of the oval window or of the round window. Such vibration measurements may be performed in a non-invasive manner by using, for example, a Laser-Doppler-vibrometer through the tympanic membrane.

It is also to be noted that the filter units 18A and 18B attenuate the ipsilateral signals by the factors $[1-(B_{21}B_{12})/(B_{11}B_{22})]$. Since $|B_{12}|<|B_{11}|$ and $|B_{21}|<|B_{22}|$ and since there are phases differences in $B_{12}$ vs. $B_{11}$ and $B_{21}$ vs. $B_{22}$, the attenuation factor can be small but never be zero, so that it can be compensated by applying the additional gain $[1-(B_{21}B_{12})/(B_{11}B_{22})]^{-1}$ to $G_1(z)$ and $G_2(z)$ respectively. Preferably, such attenuation is compensated by applying an appropriate additional gain in the audio signal processing unit 14A and 14B.

The measurement set-up of FIG. 3 may be realized by transfer function estimation units 36A and 36B provided in the right ear hearing aid 10A and the left ear hearing aid 10B, respectively. The right ear transfer function estimation unit 36A receives the signals from the contralateral vibration sensor 36B and generates a corresponding signal for adjusting the ipsilateral filter unit 18A. Accordingly, the left ear transfer function estimation unit 36B receives the signals from the contralateral vibration sensor 34A and generates a corresponding signal for adjusting the ipsilateral filter unit 18B. The system also generates control signals for turning off the respective contra-lateral audio signal processing unit 14A, 14B during transfer function measurements.

In general, the above-described principle of cross-talk compensation may be applied also to bilateral system comprising a bone conduction transducer only on one side/ear, while at the other side/ear a type of output transducer other than bone conduction is used, such as a loudspeaker.

Figure 4:
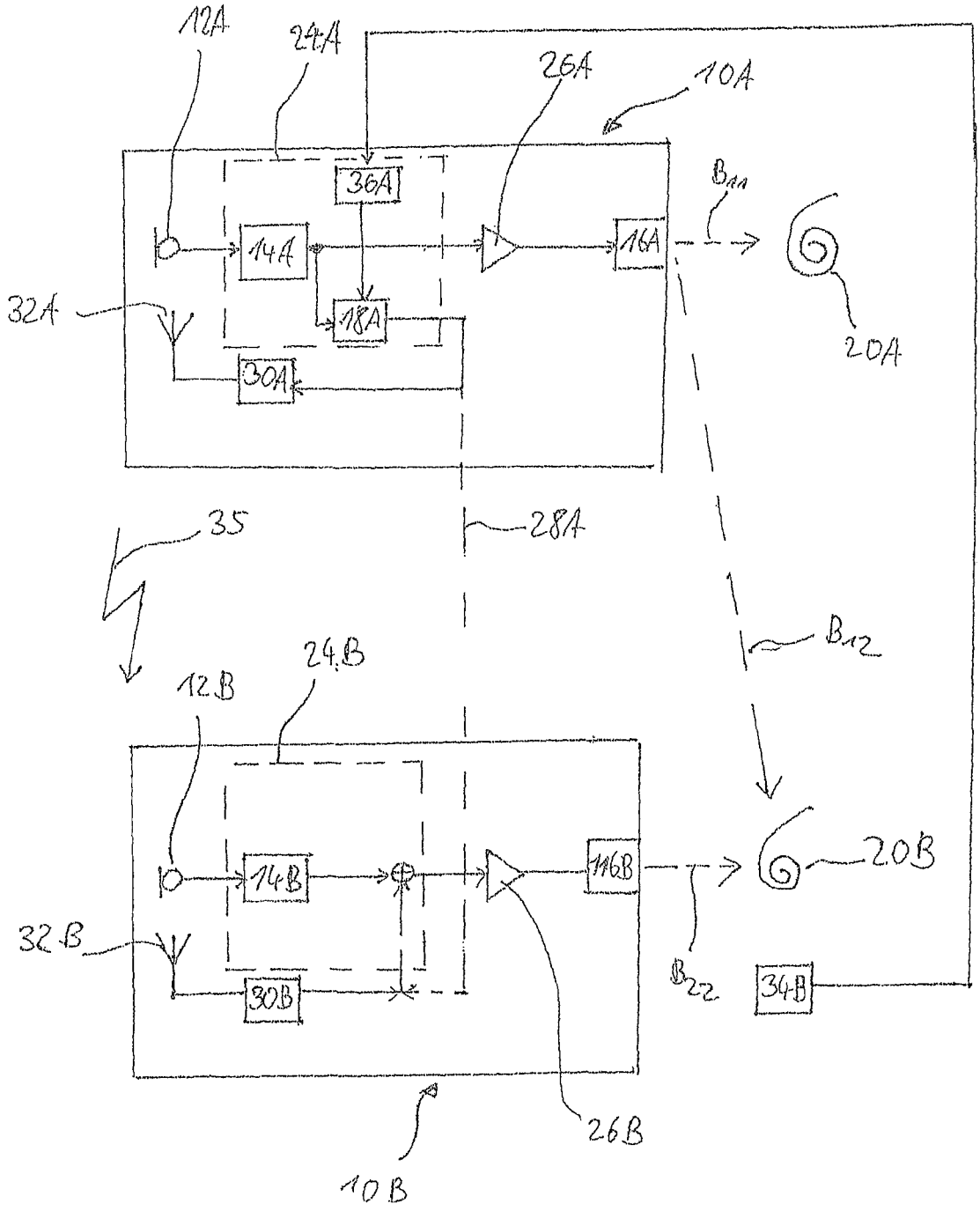
FIG. 4 is a block diagram of an example of a hearing aid system according to the invention comprising one bone conduction output transducer and one electro-acoustic or electro-mechanical output transducer.

In FIG. 4 a modification of the system of FIG. 1 is shown, wherein the left ear bone conduction output transducer 16B is replaced by a left ear output transducer 116B formed by an electro-acoustic transducer (loudspeaker) or an electro-mechanical output transducer which is mechanically directly coupled to the eardrum, the ossicular chain or the cochlea 20B of the left ear, such as an active middle ear implant or a DACS (direct acoustic cochlea stimulation) device (of course, the role of the right ear and the left ear could be interchanged).

Such type of output transducer 116B does not provide for a significant cross-talk signal to the other (right) cochlea 20A (i.e. the transcranial transfer function $B_{21}$ of FIG. 1 is very small). Therefore it is not necessary to provide for a cross-talk compensation signal from the (left ear) hearing aid 10B to the other (right ear) hearing aid 10A, so that the (left ear) hearing aid 10B does not need to have the filter unit 18B which is used in the example of FIG. 1 for generating a left ear cross-talk compensation signal (and the elements 34A, 36B used in FIG. 1 for estimating the transcranial transfer function $B_{21}$).

The impact of the cross-talk compensation signal on the gain of the left ear hearing aid 10B has to be compensated in the manner discussed above with regard to the system of FIG. 1.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. Bone conduction hearing aid system, comprising:

a right ear microphone arrangement adapted to be located at or close to a user's right ear, and a left ear microphone arrangement adapted to be located at or close to a user's left ear;

a right ear signal processing unit for processing audio signals captured by the right ear microphone arrangement from ambient sound, and a left ear signal processing unit for processing audio signals captured by the left ear microphone arrangement from ambient sound;

a right ear bone conduction output transducer adapted to be located at or close to the user's right ear for stimulating a user's right ear cochlea according to right ear output audio signals, and a left ear bone conduction output transducer adapted to be located at or close to the user's left ear for stimulating a user's left ear cochlea according to left ear output audio signals;

a right ear cross-talk compensation filter unit for generating a right ear cross-talk compensation signal from processed audio signals of the right ear signal processing unit according to an estimated transcranial transfer function from the right ear bone conduction output transducer to the left ear cochlea, and a left ear cross-talk compensation filter unit for generating a left ear cross-talk compensation signal from processed audio signals of the left ear signal processing unit according to an estimated transcranial transfer function from the left ear bone conduction output transducer to the right ear cochlea; and means for subtracting the left ear cross-talk compensation signal from the processed audio signals of the right ear signal processing unit in order to generate the right ear output audio signals, and means for subtracting the right ear cross-talk compensation signal from the processed audio signals of the left ear signal processing unit in order to generate the left ear output audio signals.

2. The system of claim 1, comprising a right ear hearing aid including the right ear microphone arrangement, the right ear signal processing unit, the right ear filter unit and the right ear bone conduction output transducer; and a left ear hearing aid including the left ear microphone arrangement, the left ear signal processing unit, the left ear filter unit and the left ear bone conduction output transducer; wherein the right ear subtracting means and the left ear subtracting means include means for establishing a bidirectional wired or wireless link between the right ear hearing aid and the left ear hearing aid.

3. The system of claim 2, wherein the audio signal processing units are adapted to use audio signals exchanged via the bidirectional link between the right and left ear hearing aids for at least one of acoustic beam-forming, noise reduction and auditory scene classification.

4. The system of claim 1, wherein the audio signal processing units are adapted to compensate, by applying an appropriate additional gain to the processed audio signals, for an attenuation of the output signals resulting from the subtraction of the cross-talk compensation signals.

5. The system of claim 1, wherein the system comprises at least one right ear accelerometer sensor adapted to pick up bone conduction sound reaching the right ear cochlea and at least one left ear accelerometer sensor adapted to pick up bone conduction sound reaching the left ear cochlea.

6. The system of claim 5, wherein the accelerometer sensors adapted for being attached to a skull on a mastoid at a position as close to the respective cochlea as possible.

7. The system of claim 1, wherein the output transducers are adapted for direct contact with a skin at a user's skull.

8. The system of claim 1, wherein the output transducers are adapted for engagement with implantable abutments.

9. A hearing aid system, comprising:

a first ear microphone arrangement adapted to be located at or close to a user's first ear, and a second ear microphone arrangement adapted to be located at or close to a user's second ear;

a first ear signal processing unit for processing audio signals captured by the first ear microphone arrangement from ambient sound, and a second ear signal processing unit for processing audio signals captured by the second ear microphone arrangement from ambient sound;

a first ear bone conduction output transducer adapted to be located at or close to the user's first ear for stimulating a user's first ear cochlea according to first ear output audio signals, and a second ear output transducer adapted to be located at the user's second ear for stimulating a user's second ear cochlea according to second ear output audio signals, wherein the second output transducer is a loudspeaker for emitting sound into an ear canal or an electro-mechanical transducer to be directly coupled to an eardrum, an ossicular chain or the cochlea;

a first ear cross-talk compensation filter unit for generating a first ear cross-talk compensation signal from processed audio signals of the first ear signal processing unit according to an estimated transcranial transfer function from the first ear bone conduction output transducer to the second ear cochlea; and means for subtracting the first ear cross-talk compensation signal from processed audio signals of the second ear signal processing unit in order to generate the second ear output audio signals.

10. A method of providing hearing assistance to a user, comprising:

capturing right ear audio signals from ambient sound at a position at or close to a user's right ear, and capturing left ear audio signals from ambient sound at a position at or close to a user's left ear;

processing the right ear audio signals, and processing the left ear audio signals;

generating a right ear cross-talk compensation signal from the processed right ear audio signals according to an estimated transcranial transfer function from a right ear bone conduction output transducer located at or close to a user's right ear to a left ear cochlea, and generating a left ear cross-talk compensation signal from processed left ear audio signals according to an estimated transcranial transfer function from a left ear bone conduction output transducer located at or close to the user's left ear to a right ear cochlea;

subtracting the left ear cross-talk compensation signal from the right ear processed audio signals in order to generate right ear output audio signals, and subtracting the right ear cross-talk compensation signal from the processed left ear audio signals in order to generate left ear output audio signals; and stimulating the user's right ear cochlea by the right ear bone conduction output transducer according to the right ear output audio signals, and stimulating the user's left ear cochlea by the left ear bone conduction output transducer according to the left ear output audio signals.

11. The method of claim 10, wherein for generating the right ear cross-talk compensation signal also an estimated cranial transfer function from the left ear bone conduction output transducer to the left ear cochlea is taken into account, and wherein for generating the left ear cross-talk compensation signal also an estimated cranial transfer function from the right ear bone conduction output transducer to the right ear cochlea is taken into account.

12. The method of claim 11, wherein the right ear cross-talk compensation signal is generated by amplifying the processed right ear audio signals by a factor corresponding to the ratio of the estimated cranial transfer function from the right ear output transducer to the right ear cochlea and the estimated transcranial transfer function from the left ear output transducer to the right ear cochlea, multiplied by a ratio of the right ear output transducer transfer function to the left ear output transducer transfer function, and wherein the left ear cross-talk compensation signal is generated by amplifying the processed left ear audio signals by a factor corresponding to a ratio of the estimated cranial transfer function from the left ear output transducer to the left ear cochlea and the estimated transcranial transfer function from the right ear output transducer to the left ear cochlea, multiplied by a ratio of the left ear output transducer transfer function to the right ear output transducer transfer function.

13. The method of claim 11, wherein the estimated transcranial transfer functions and the estimated cranial transfer functions are estimated by picking up bone conduction sound reaching the right ear cochlea and bone conduction sound reaching the left ear cochlea by using vibration sensors attached to a skull on a mastoid at a position as close to the respective cochlea as possible, and wherein bone conduction sound is generated by the right ear and left ear bone conduction output transducers.

14. The method of claim 13, wherein the vibration sensors are accelerometer sensors.

15. The method of claim 11, wherein the estimated transcranial transfer function and the estimated cranial transfer function for one of the right ear and the left ear are estimated by supplying contralateral processed audio signals to a contralateral bone conduction output transducer, supplying the contralateral cross-talk compensation signal generated from the contralateral processed audio signals to an ipsilateral bone conduction output transducer, and picking up signals by an ipsilateral vibration sensor, with no ipsilateral processed audio signals being supplied to the ipsilateral bone conduction output transducer.

16. The method of claim 15, wherein the contralateral cross-talk compensation signal is adjusted so as to minimize the signal picked-up by the ipsilateral vibration sensor.

17. The method of claim 16, wherein an LMS algorithm is used to minimize the signal picked-up by the ipsilateral vibration sensor.

18. The method of claim 16, wherein, after minimizing the signal picked-up by the ipsilateral vibration sensor, the contralateral cross-talk compensation signal is further adjusted by loudness measurements so as to minimize loudness perception in the ipsilateral ear.

19. A method of providing hearing assistance to a user, comprising:

capturing first ear audio signals from ambient sound at a position at or close to a user's first ear, and capturing second ear audio signals from ambient sound at a position at or close to a user's second ear;

processing the first ear audio signals, and processing the second ear audio signals;

generating a first ear cross-talk compensation signal from processed first ear audio signals according to an estimated transcranial transfer function from a first ear bone conduction output transducer located at or close to the user's first ear to a second ear cochlea;

subtracting the first ear cross-talk compensation signal from processed second ear audio signals in order to generate second ear output audio signals; and stimulating a user's first ear cochlea by the first ear bone conduction output transducer according to the first ear output audio signals, and stimulating the user's second ear cochlea by a second ear output transducer located at the user's second ear according to the second ear output audio signals, wherein the second ear output transducer is a loudspeaker which emits sound into an ear canal, or an electro-mechanical transducer which is directly coupled to a eardrum, an ossicular chain or the cochlea of the user's second ear.

* * * * *